US011167959B2

(12) United States Patent
Heimann et al.

(10) Patent No.: US 11,167,959 B2
(45) Date of Patent: Nov. 9, 2021

(54) METHOD AND SYSTEM FOR AVOIDING COLLISIONS IN CRANES

(71) Applicant: Siemens Aktiengesellschaft, Munich (DE)

(72) Inventors: Thomas Heimann, Erlangen (DE); Marcel Bals, Cologne (DE); Axel Rottmann, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 173 days.

(21) Appl. No.: 16/315,106

(22) PCT Filed: Jun. 27, 2017

(86) PCT No.: PCT/EP2017/065835
§ 371 (c)(1),
(2) Date: Jan. 3, 2019

(87) PCT Pub. No.: WO2018/007203
PCT Pub. Date: Jan. 11, 2018

(65) Prior Publication Data

US 2019/0308852 A1 Oct. 10, 2019

(30) Foreign Application Priority Data

Jul. 4, 2016 (DE) ..... 10 2016 212 123.5

(51) Int. Cl.
*B66C 15/04* (2006.01)
*B66C 13/16* (2006.01)
(Continued)

(52) U.S. Cl.
CPC ..... *B66C 15/045* (2013.01); *B66C 13/16* (2013.01); *B66C 13/18* (2013.01); *B66C 13/46* (2013.01); *B66C 19/007* (2013.01)

(58) Field of Classification Search
CPC ..... B66C 15/045; B66C 13/16; B66C 13/18; B66C 13/46; B66C 19/007
See application file for complete search history.

(56) References Cited

U.S. PATENT DOCUMENTS 7,216,806 B2 * 5/2007 Kurita ..... G06Q 10/08 235/375
7,972,102 B2 * 7/2011 Ward ..... B66C 19/002 414/137.1
(Continued)

FOREIGN PATENT DOCUMENTS

CN 2820303 Y 9/2006
CN 1997490 A 7/2007
(Continued)

OTHER PUBLICATIONS

"PCT International Search Report and Written Opinion of International Searching Authority dated Sep. 11, 2017 corresponding to PCT international Application No. PCT/EP2017/065835 filed Jun. 27, 2017".

*Primary Examiner* — Behrang Badii
*Assistant Examiner* — Daniel L Greene
(74) *Attorney, Agent, or Firm* — Henry M. Feiereisen LLC

(57) ABSTRACT

In a method for preventing a collision of a load of a crane with an obstacle, a height profile of the obstacle is captured along a trajectory of movement of the load by at least two sensors for distance measurement. Signals of the sensors are transmitted via at least two communication channels to a controller having at least two operating systems. At least one of the operating systems has a safety program in a secure area. The obstacle is identified along the trajectory via the height profile. The controller includes a secure communications interface for transmitting signals from the controller to a crane control.

23 Claims, 2 Drawing Sheets

(51) Int. Cl.

| | |
|---|---|
| ***B66C 13/18*** | (2006.01) |
| ***B66C 13/46*** | (2006.01) |
| ***B66C 19/00*** | (2006.01) |

(56) References Cited

U.S. PATENT DOCUMENTS

| | | | | |
|---|---|---|---|---|
| 9,260,276 | B2 * | 2/2016 | Stocker | B66C 13/46 |
| 2008/0119960 | A1 | 5/2008 | Beaulieur et al. | |
| 2010/0243593 | A1 * | 9/2010 | King | B66C 13/46 212/276 |
| 2017/0003662 | A1 * | 1/2017 | Lane | G05B 9/02 |
| 2017/0097626 | A1 * | 4/2017 | Kaufleitner | G05B 11/011 |

FOREIGN PATENT DOCUMENTS

| | | | |
|---|---|---|---|
| CN | 201343377 | Y | 11/2009 |
| CN | 101700854 | A | 5/2010 |
| CN | 102336366 | A | 2/2012 |
| CN | 203229326 | U | 10/2013 |
| CN | 203284078 | U | 11/2013 |
| CN | 204125059 | U | 1/2015 |
| CN | 104649146 | A | 5/2015 |
| EP | 2927178 | A1 | 10/2015 |
| JP | 2005104665 | A | 4/2005 |

* cited by examiner

METHOD AND SYSTEM FOR AVOIDING COLLISIONS IN CRANES

CROSS-REFERENCES TO RELATED APPLICATIONS

This application is the U.S. National Stage of International Application No. PCT/EP2017/065835, filed Jun. 27, 2017, which designated the United States and has been published as International Publication No. WO 2018/007203 and which claims the priority of German Patent Application, Serial No. 10 2016 212 123.5, filed Jul. 4, 2016, pursuant to 35 U.S.C. 119(a)-(d).

BACKGROUND OF THE INVENTION

In particular when handling containers in the stacking region, collisions frequently occur which may in some circumstances lead to deaths. The existing solutions for collision avoidance are only serviceable to a limited extent, since on the one hand they can only act in a supporting manner (with the crane driver and the operator who are trained accordingly remaining responsible) and on the other hand the error rate is relatively high. In crane types in which the crane driver travels along with the crane trolley, there is also no direct view of obstacles when reversing.

SUMMARY OF THE INVENTION

The object of the invention is to specify a solution for collision avoidance which fulfills a level of safety.

This object is achieved by a method for avoiding a collision of a load of a crane with an obstacle, wherein the load is moved along a trajectory, wherein a height profile is acquired at least along the trajectory by means of at least two sensors for distance measurement, wherein signals of the sensors are sent via at least two communication channels to a controller with at least two operating systems, of which at least one has a safety program in a secure region, wherein an obstacle along the trajectory is identified on the basis of the height profile.

The object is further achieved by a system for avoiding a collision of a load of a crane with an obstacle, wherein the load is able to be moved along a trajectory, having at least two sensors for distance measurement, with which a height profile is able to be acquired at least along the trajectory, a controller with at least two operating systems, of which at least one has a safety program in a secure region, at least two communication channels for transmitting signals of the sensors to the controller, and also a secure communication interface for transmitting signals from the controller to a crane control.

The object is further achieved by a crane, a program and a computer-readable medium as set forth hereinafter.

By using a controller with a second operating system, on which a safety program (certified safety program) runs in a secure region, and the two-channel nature, it is possible to achieve a level of safety (safety integrity level "SIL" or performance level "PL"). If an obstacle is identified, a secure signal can be sent to the crane controller via the secure communication interface, for example via two-channel hardware or via a PROFISAFE bus. PROFISAFE is a safety communication technology for discrete manufacturing and process automation systems. In this manner, collisions can be prevented securely, as required by the operators. In this context, even in cases of empty runs, collisions between a container spreader and the obstacle for example can be avoided, since in this case said spreader is the load which is moved along the trajectory.

Internal checking and testing algorithms (separated in the normal and the secure operating systems) and the consistent two-channel nature mean that it is possible to realize a level of safety according to EN ISO 13849-1 of Performance Level c, Category 2 (EN 954-1). By way of a TÜV test certificate in Germany, for example, a worldwide implementation and a corresponding acceptance are possible.

In one advantageous form of embodiment, the height profile is at least stored in the secure region. This can happen e.g. during a "forward run", so that the data is available for the "reverse run" and can be used for identifying an obstacle. In this context, acquiring the height profile can take place during the movement of the load along the trajectory, but also in advance thereof. Likewise, the entire height profile can naturally also be recorded in the working area of the crane in advance. If the crane is a container crane, for example, which unloads containers in a container terminal as loads, then the stack heights of the containers result in a "container mountain" as the height profile to a certain extent.

In a further advantageous form of embodiment, a secure stop signal is sent to a crane control by the safety program if an obstacle is acquired within a first clearance from the load in the direction of movement of the load. As a result of this, a first safety region is defined in front of the load, within which the crane can be promptly and securely stopped when an obstacle appears.

In a further advantageous embodiment, in this context the size of the first clearance is adapted to a speed of the load. Thus, the clearance e.g. when stacking a container on a stack, of which the adjacent stack is already taller, can be adapted accordingly, so that no stop signal is sent when approaching the adjacent stack. The size of the clearance can thereby also be adapted to zero. By the same token, the clearance can be increased accordingly with greater working speeds of the crane, so that in any case the load can be held in front of the obstacle in good time.

In a further advantageous form of embodiment, the safety program sends a secure brake signal to a crane control if an obstacle within a second distance from the load in the direction of movement of the load is acquired. As a result of this, a second safety region is defined in front of the load, within which the crane is promptly and securely braked when an obstacle appears. As a result, it can be signaled to the crane control for example to change from normal working speed to a "low-speed run".

Particularly advantageous here is a form of embodiment in which a stop signal is output to the control within a first clearance, since the load is thus initially braked within the second clearance and is then stopped when the obstacle appears within the first clearance while running more slowly.

In a further advantageous embodiment, in this context the size of the second clearance is adapted to a speed of the load. The size of the clearance can also be adapted to zero here, if the crane e.g. is already in a low-speed run. Conversely, the clearance can be increased accordingly with greater working speeds of the crane, so that in any case the load can be braked in front of the obstacle in good time.

In a further advantageous form of embodiment, the trajectory is adapted to the height profile. In this manner, a trajectory is chosen in which possible collisions with an obstacle are avoided equally. It is also possible, if at least one part of the working area of the crane has already been stored as a height profile, to choose a time-optimized trajectory which bypasses the potential obstacles.

In a further advantageous form of embodiment, a position of the load is acquired by means of at least one sensor and compared with an already known position, and if these differ, the functionality of the at least one sensor for distance measurement and/or of the measuring system, with which the known position has been determined, is checked. In this context, the known position values are removed from the axes by measuring systems, for example, wherein the position of the load results from the position values of the crane, the hoist gear and the trolley. By comparing with the sensor data, it is ensured that the position of the load is precisely known at all times and the crane driver is securely supported.

In a further advantageous form of embodiment, a range of visibility is determined by means of at least one sensor. If the range of visibility is impaired by snow or fog for example, this can also be ascertained in an automatic operation and the operation can be adapted accordingly (at reduced speed) or even ceased.

In a further advantageous form of embodiment, at least two computing units are used as controller. For example, the controller (=control unit of the system according to the invention) can comprise a standard PC and a safety PC, or even two computing units which are consolidated in a single housing.

In a further advantageous form of embodiment, at least two sensors measure distances along lines which intersect at at least one point of intersection, and the measured values at at least one point of intersection are used for validating a secure measured value.

In an advantageous form of embodiment of the system, at least one of the sensors is designed as a 2D laser scanner.

In a further advantageous form of embodiment, at least one of the sensors is designed as a 3D laser scanner.

In a further advantageous form of embodiment, two sensors measure distances along lines which form at least one right angle.

In a further advantageous form of embodiment, at least one sensor is designed as a multibeam laser.

In a further advantageous form of embodiment, at least one operating system is real-time-capable.

In a further advantageous form of embodiment, at least one sensor is able to be arranged on a trolley of the crane.

In a further advantageous form of embodiment, at least one of the sensors is able to be arranged on a container spreader of the crane.

BRIEF DESCRIPTION OF THE DRAWING

The invention is described and explained in more detail below on the basis of the exemplary embodiments shown in the figures, in which.

DETAILED DESCRIPTION OF PREFERRED EMBODIMENTS

Figure 1:
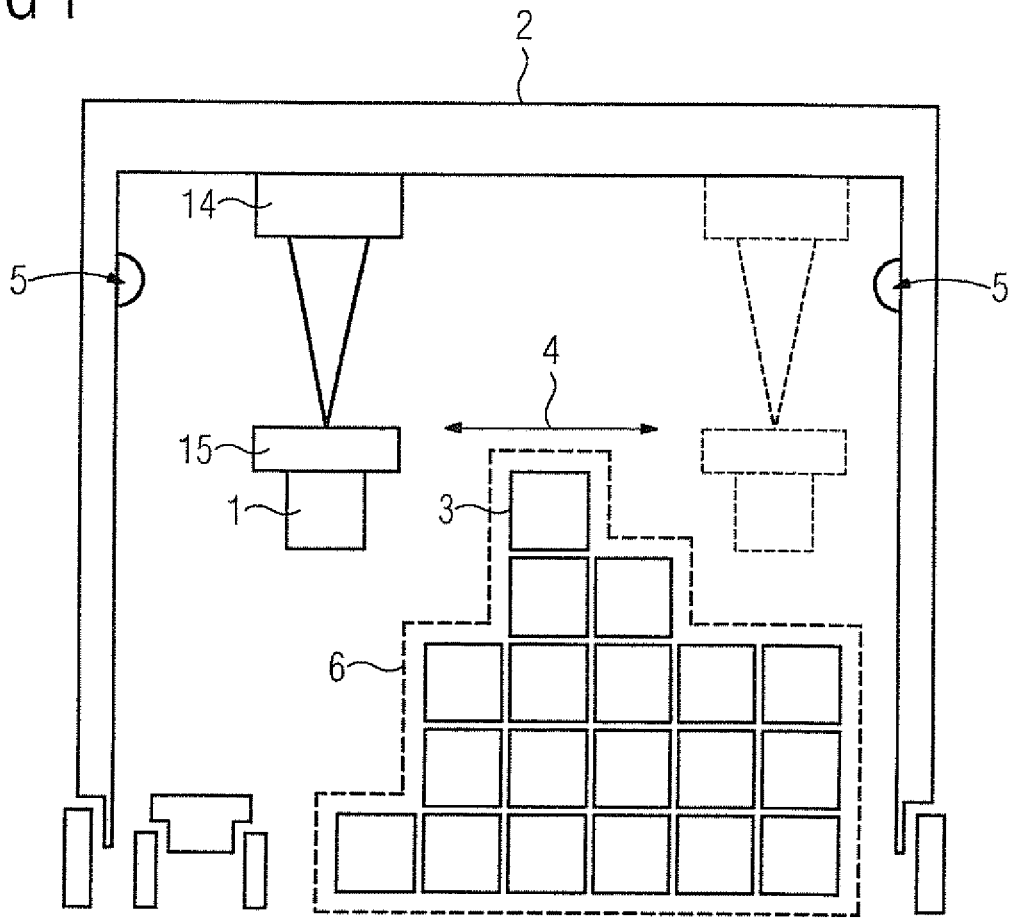
FIG. 1 shows a schematic representation of a crane.

FIG. 1 shows a schematic representation of a crane 2, which is designed as a portal crane in the figure (e.g. as an RTG, "Rubber Tired Gantry"). A load 1, in the image a container, is fastened to a container spreader 15, which is able to travel from left to right in the image by means of a trolley 14. The load 1 is intended to be moved along a trajectory 4, wherein a height profile 6 ("container mountain") at least along the trajectory 4 is determined by at least two sensors for distance measurement 5. Located along the trajectory 4 is an obstacle 3, meaning that the load is not able to be transported to its destination along a direct path (shown as a dashed line). By way of the method according to the invention, the trajectory 4 is adapted to a parabolic movement which safely clears the obstacle 3.

Figure 2:
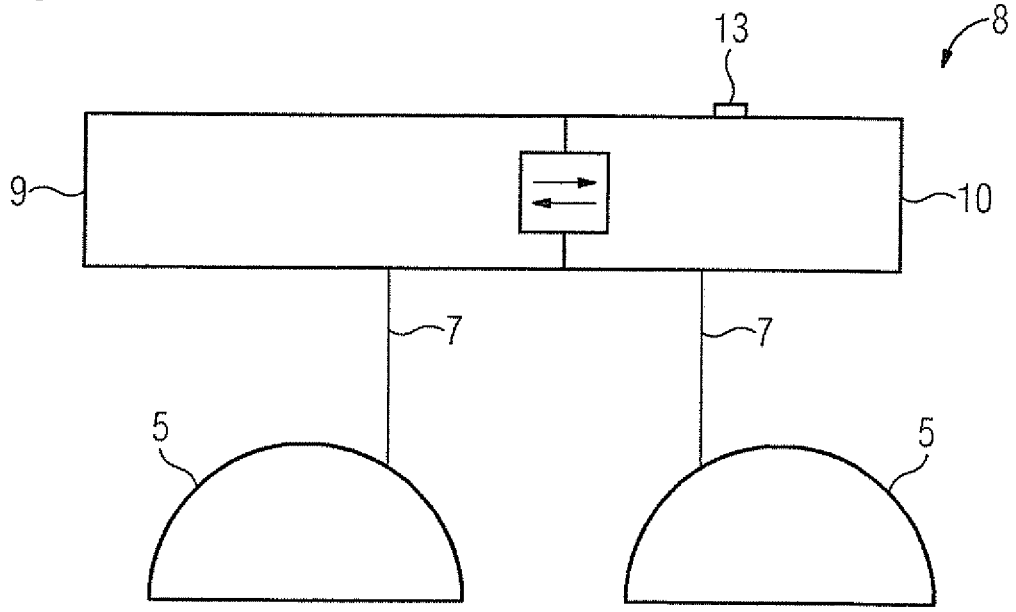
FIG. 2 shows a controller according to the invention.

FIG. 2 shows a representation of the at least two sensors for distance measurement 5, which are connected to a controller 8 via a communication channel 7 in each case. The controller 8 has at least two operating systems 9, 10, of which at least one 10 has a safety program in a secure region. The operating systems 9, 10 are advantageously real-time-capable operating systems 9, 10. The communication with a crane control, in particular for sending a secure stop and/or brake signal, takes place via a secure communication interface 13, which e.g. can be designed as a secure bus (such as PROFISAFE) or as a two-channel hardware interface.

Figure 3:
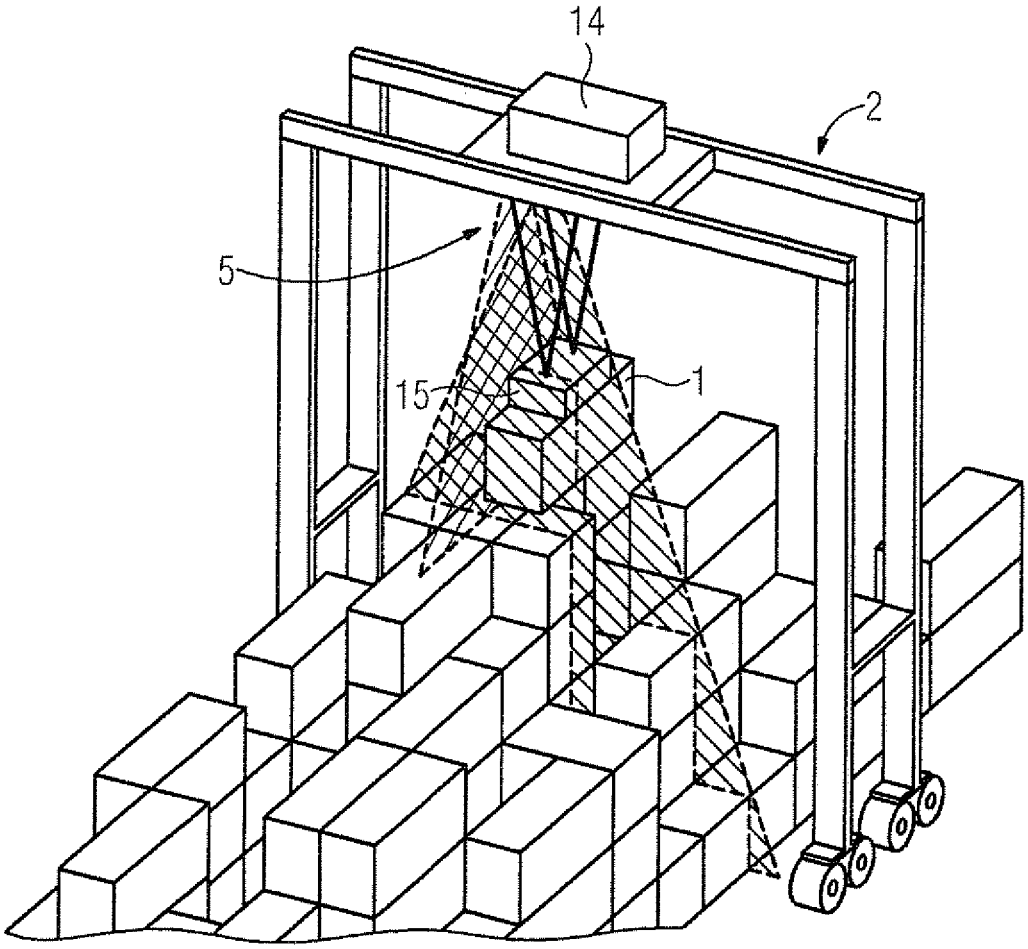
FIG. 3 shows an arrangement of two sensors on a bridge crane.

FIG. 3 shows a perspective representation of a crane 2 as in FIG. 1, in which a load 1 is able to travel on a spreader 15 via a trolley 14. In this case, the sensors 5 are arranged on the trolley 14, wherein at least 2D laser scanners are chosen as sensors 5. In this context, one of the sensors 5 records a height profile 6 past one side of the load 1, while a second of the sensors 5 acquires distances while being offset by 90 degrees in relation to the first sensor in the direction of movement of the trolley 14. Here, this second laser scanner additionally acquires the position of the load 1 via the trolley position and the spreader height.

Figure 4:
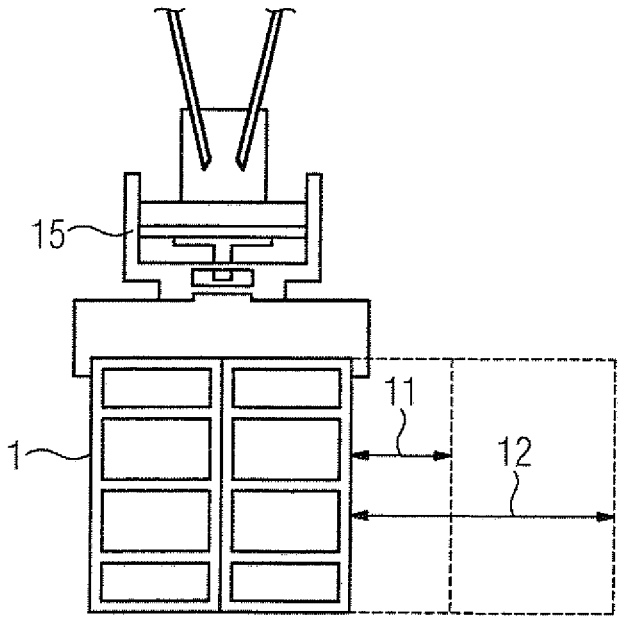
FIG. 4 shows a representation of safety clearances of the load.

FIG. 4 shows a representation of safety clearances 11, 12, within which an obstacle 3 triggers a secure brake signal if an obstacle 3 is acquired within the second clearance 12, and a secure stop signal is triggered if an obstacle 3 is acquired within the first clearance 11. A monitoring of said safety regions emerging from the safety clearances 11, 12 is possible in this context in a simple manner for example using an arrangement of sensors 5 as has been shown in the preceding FIG. 3.

In summary, the invention relates to a method and a system for avoiding a collision of a load of a crane with an obstacle, and also to a crane with a system of this kind, to a program for carrying out a method of this kind and to a computer-readable medium with a program of this kind. In order to specify a solution for collision avoidance, which fulfills a level of safety, a solution is proposed in which the load is moved along a trajectory, wherein a height profile is acquired at least along the trajectory by means of at least two sensors for distance measurement, wherein signals of the sensors are sent via at least two communication channels to a controller with at least two operating systems, of which at least one has a safety program in a secure region, wherein an obstacle along the trajectory is identified on the basis of the height profile. Furthermore, the controller has a secure communication interface for transmitting signals from the controller to a crane control.

The invention claimed is:

1. A method for avoiding a collision of a load of a crane with an obstacle, comprising:

acquiring a height profile of the obstacle along a trajectory of movement of the load by a plurality sensors for distance measurement;

sending signals of the sensors via at least two communication channels to a controller with at least two operating systems, of which at least one of the at least two operating systems runs a safety program in a secure region of the controller; and identifying the obstacle along the trajectory on the basis of the height profile, sending a secure stop signal to a crane control by the safety program via a secure communication interface, when the obstacle is acquired within a first clearance from the load in a direction of movement of the load.

2. The method of claim 1, further comprising storing the height profile in the secure region.

3. The method of claim 1, further comprising adapting a size of the first clearance to a speed of the load.

4. The method of claim 1, further comprising sending a secure brake signal to a crane control by the safety program when the obstacle is acquired within a second clearance from the load in a direction of movement of the load.

5. The method of claim 4, further comprising adapting a size of the second clearance to a speed of the load.

6. The method of claim 1, further comprising adapting the trajectory to the height profile.

7. The method of claim 1, further comprising:

acquiring a position of the load by at least one of the sensors;

comparing the position of the load with a known position; and checking, when the position of the load differs from the known position, a functionality of the at least one of the sensors for distance measurement and/or of a measuring system, with which the known position has been determined.

8. The method of claim 1, further comprising determining a range of visibility by at least one of the sensors.

9. The method of claim 1, wherein at least two computing units are used as controller.

10. The method of claim 1, further comprising:

measuring distances along lines which intersect at at least one point of intersection by least two of the sensors; and using the measured values at the at least one point of intersection for validating a secure measured value.

11. A system for avoiding a collision of a load of a crane with an obstacle, comprising:

a plurality of sensors for distance measurement, said sensors being configured to acquire a height profile along a trajectory of movement of the load;

a controller including at least two operating systems, of which at least one of the operating systems runs a safety program in a secure region of the controller;

at least two communication channels for transmitting signals of the sensors to the controller;

a secure communication interface configured to transmit signals from the controller to a crane control, a secure stop signal configured to be sent to the crane control by the safety program via the secure communication interface, when the obstacle is acquired within a first clearance from the load in a direction of movement of the load.

12. The system of claim 11, wherein at least one of the sensors is configured as a 2D laser scanner.

13. The system of claim 11, wherein at least one of the sensors is configured as a 3D laser scanner.

14. The system of claim 11, wherein two of the sensors measure distances along lines which form at least one right angle.

15. The system of claim 11, wherein at least one sensor is configured as a multibeam laser.

16. The system of claim 11, wherein at least one of the operating systems is real-time-capable.

17. The system of claim 11, wherein at least one of the sensors is configured for arrangement on a trolley of the crane.

18. The system of claim 11, wherein at least one of the sensors is configured for arrangement on a container spreader of the crane.

19. The system of claim 11, wherein the controller comprises at least two computing units.

20. The system of claim 11, wherein at least two of the sensors measure distances along lines which intersect at least one point of intersection, and wherein the measured values of the at least one point of intersection are used for validating a secure measured value.

21. A crane, comprising a system for avoiding a collision of a load of a crane with an obstacle, said system comprising a plurality of sensors for distance measurement, said sensors being configured to acquire a height profile along a trajectory of movement of the load, a controller including at least two operating systems, of which at least one of the operating systems runs a safety program in a secure region of the controller, at least two communication channels for transmitting signals of the sensors to the controller, a secure communication interface configured to transmit signals from the controller to a crane control, and a secure stop signal configured to be sent to the crane control by the safety program via the secure communication interface, when the obstacle is acquired within a first clearance from the load in a direction of movement of the load.

22. A computer program embodied in a non-transitory computer-readable medium, wherein the computer program, when loaded into a controller and executed by the controller, causes the controller to perform a method for avoiding a collision of a load of a crane with an obstacle, comprising:

acquiring a height profile of the obstacle along a trajectory of movement of the load by a plurality of sensors for distance measurement;

sending signals of the sensors via at least two communication channels to a controller with at least two operating systems, of which at least one of the at least two operating systems runs a safety program in a secure region of the controller;

identifying the obstacle along the trajectory on the basis of the height profile; and sending a secure stop signal to a crane control by the safety program via a secure communication interface, when the obstacle is acquired within a first clearance from the load in a direction of movement of the load.

23. A non-transitory computer-readable medium, having stored thereon a computer program with instructions that, when executed by a controller, causes the controller to perform a method for avoiding a collision of a load of a crane with an obstacle, comprising:

acquiring a height profile of the obstacle along a trajectory of movement of the load by a plurality of sensors for distance measurement;

sending signals of the sensors via at least two communication channels to a controller with at least two operating systems, of which at least one of the at least two operating systems runs a safety program in a secure region of the controller;

identifying the obstacle along the trajectory on the basis of the height profile; and sending a secure stop signal to a crane control by the safety program via a secure communication interface, when the obstacle is acquired within a first clearance from the load in a direction of movement of the load.

* * * * *